US006537639B1

(12) United States Patent
Huang

(10) Patent No.: US 6,537,639 B1
(45) **Date of Patent: *Mar. 25, 2003**

(54) CUSHION ASSEMBLY WITH ALIGNED AIR CHAMBERS

(76) Inventor: Ing-Chung Huang, No. 218 Cheng Kung Three Road, Nantou City (TW)

( * ) Notice: Subject to any disclaimer, the term of this patent is extended or adjusted under 35 U.S.C. 154(b) by 97 days.

This patent is subject to a terminal disclaimer.

(21) Appl. No.: 09/656,270

(22) Filed: Sep. 6, 2000

Related U.S. Application Data

(63) Continuation-in-part of application No. 08/876,490, filed on Jun. 16, 1997, now abandoned.

(51) Int. Cl.[7] ..... A43B 13/20; B32B 3/02

(52) U.S. Cl. ..... 428/72; 36/29; 428/76; 428/137; 428/178; 428/212

(58) Field of Search ..... 428/72, 76, 137, 428/178, 212; 36/29

(56) References Cited

U.S. PATENT DOCUMENTS 4,670,995 A * 6/1987 Huang ..... 36/29
5,902,660 A * 5/1999 Huang ..... 428/72

* cited by examiner

*Primary Examiner*—Sandra M. Nolan
(74) *Attorney, Agent, or Firm*—Bacon & Thomas, PLLC

(57) ABSTRACT

A buffer air cushion has an outer air cushion and an inner air cushion disposed in the outer air cushion. The outer air cushion is inflated with a smaller inner pressure than that of the inner air cushion so that the buffer air cushion may have better pressure elasticity and shock-absorbing functions.

6 Claims, 6 Drawing Sheets

CUSHION ASSEMBLY WITH ALIGNED AIR CHAMBERS

REFERENCE TO RELATED APPLICATION

This is a continuation-in-part application of application Ser. No. 08/876,490, filed on Jun. 16, 1997, and now abandoned.

BACKGROUND OF THE INVENTION

Common conventional air cushions are generally made of a single layer of material that is inflated with a preset pressure for producing a buffering and shock-absorbing effect. In practical use, they are not only inferior in stability but also have a short service life because a high pressure inflation of the cushion will cause harm to its structure.

SUMMARY OF THE INVENTION

The purpose of the present invention is to provide a buffer air cushion that includes an outer air cushion having an inner air cushion disposed therein.

The main feature of the invention resides in the outer air cushion having a first inner pressure and the inner air cushion having a second inner pressure that is higher than the first inner pressure of the outer air cushion, thus providing a better buffering and shock-absorbing effect than conventional air cushions.

BRIEF DESCRIPTION OF THE DRAWINGS

This invention will be better understood from the following detailed description and the accompanying drawings, wherein.

DETAILED DESCRIPTION OF THE PREFERRED EMBODIMENTS

Figure 1:
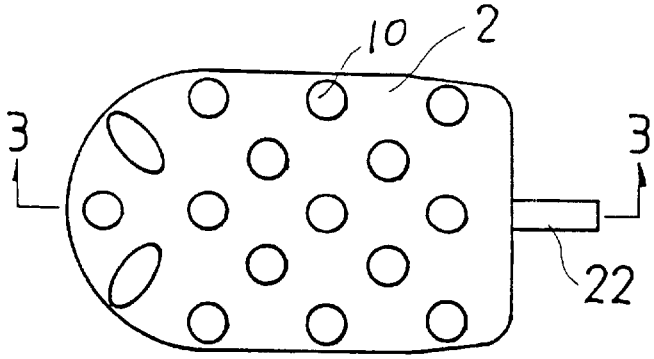
FIG. 1 is a top view of a first preferred embodiment of an inner air cushion utilized in the present invention.
Figure 2:
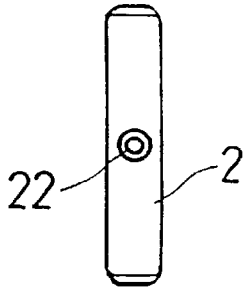
FIG. 2 is a right end view of the cushion shown in FIG. 1.
Figure 3:
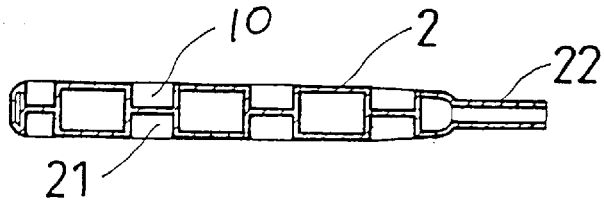
FIG. 3 is a cross-sectional view taken along the line 3—3 in FIG. 1.
Figure 4:
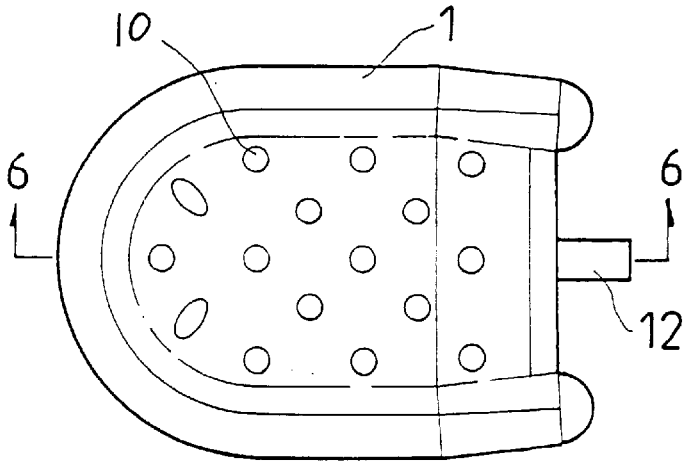
FIG. 4 is a top view of a first preferred embodiment of an outer air cushion utilized in the present invention.
Figure 5:
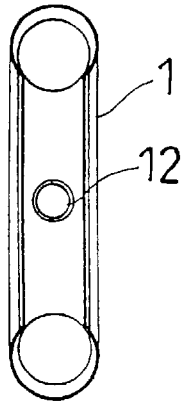
FIG. 5 is a right end view of the cushion shown in FIG. 4.
Figure 6:
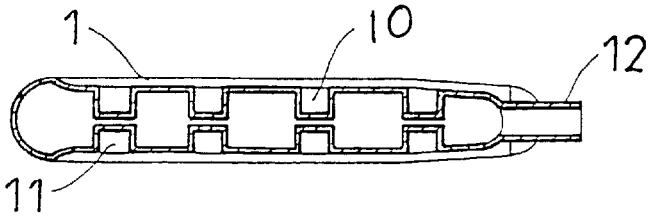
FIG. 6 is a cross-sectional view taken along the line 6—6 in FIG. 4.
Figure 7:
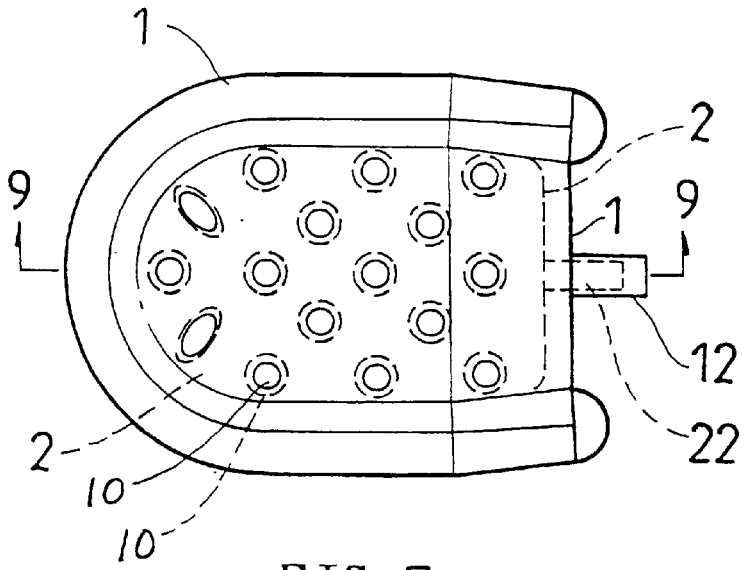
FIG. 7 is a top view of the first preferred embodiment of the inner air cushion and the outer air cushion shown in FIGS. 1–6 assembled together.
Figure 8:
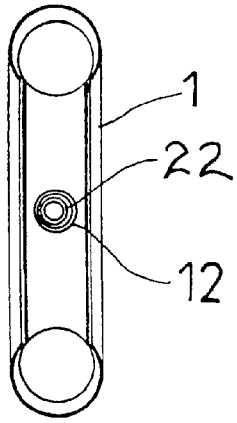
FIG. 8 is a right end view of the assembly of FIG. 7.
Figure 9:
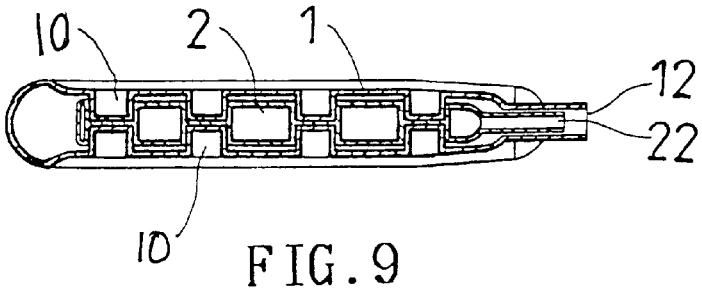
FIG. 9 is a cross-sectional view taken along the line 9—9 in FIG. 7.
Figure 11:
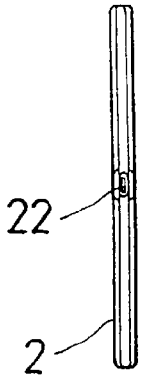
FIG. 11 is a right end view of the cushion shown in FIG. 10.
Figure 10:
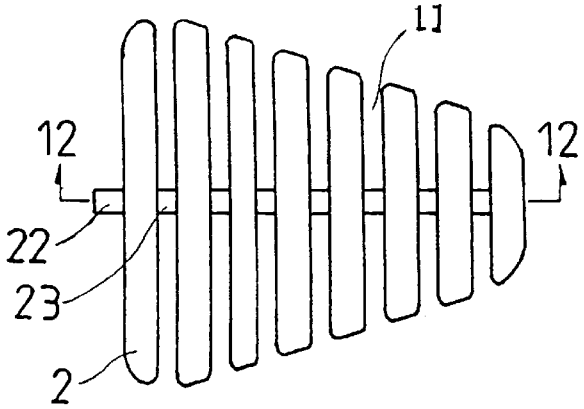
FIG. 10 is a top view of a second preferred embodiment of an inner air cushion utilized in the present invention.
Figure 12:
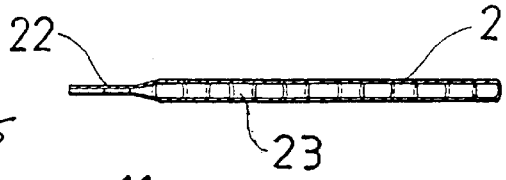
FIG. 12 is a cross-sectional view taken along the line 12—12 in FIG. 10.
Figure 14:
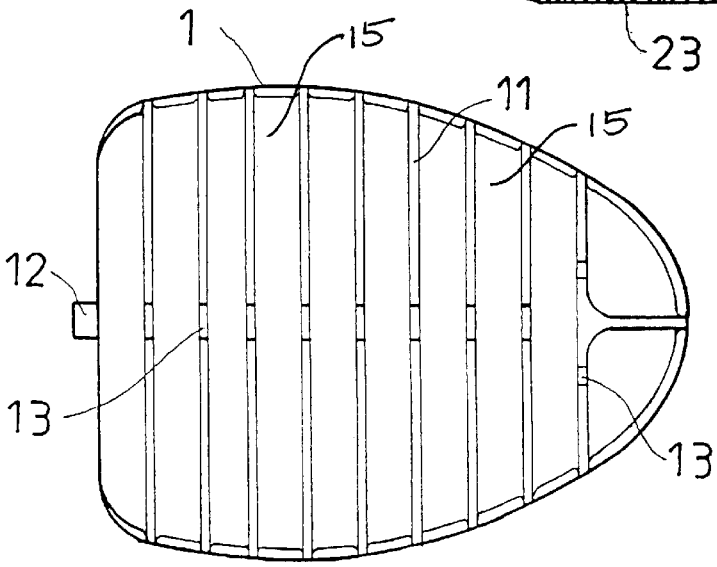
FIG. 14 is a top plan view of the cushion shown in FIG. 13.
Figure 15:
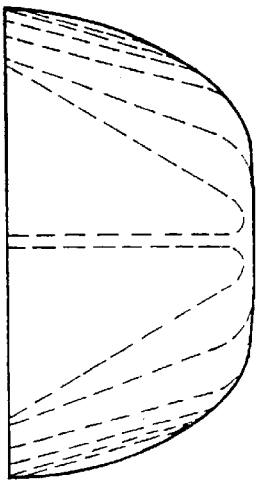
FIG. 15 is a right end view of the cushion shown in FIG. 13.
Figure 13:
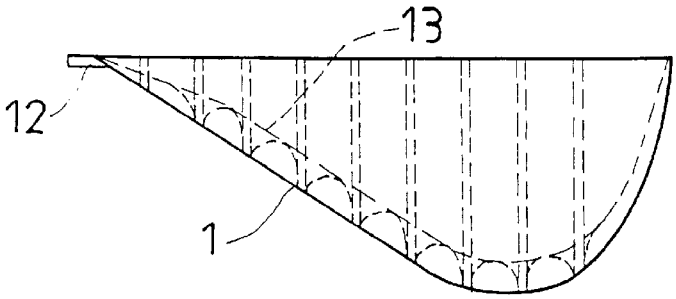
FIG. 13 is a side elevational view of a second preferred embodiment of an outer air cushion utilized in the present invention.

FIGS. 1–3 and FIGS. 10–12 show an inner air cushion 2 of, respectively, a first and a second preferred embodiment of the buffer air cushion, and FIGS. 4–6 and FIGS. 13–15 show an outer air cushion 1 of, respectively, a first and a second preferred embodiment of the buffer air cushion in the present invention. The inner and the outer air cushions 2, 1 both have an unrestricted shape, and a plurality of recessed holes 10 or grooves 11 in both an upper and a lower surface to collectively define a plurality of air chambers. Each hole 10 may be of any geometric shape, and each groove 11 may be straight or curved. Further, the recessed holes 10 or grooves 11 in both surfaces of the outer and the inner air cushions 1, 2 are in coaxial alignment with each other. The outer air cushion 1 further has a hollow inlet 12 communicating with ambient air for inflating same with a gas, after which inlet 12 is sealed up.

The inner air cushion 2 also has a plurality of recessed holes 10 or grooves 11 which correspond in position to those of the outer air cushion 1 and disposed in coaxial alignment therewith, the height being shorter than the inner height of the outer air cushion 1, and the width being smaller than the inner hollow width of the outer air cushion 1. The recessed holes 10 or grooves 11 of the inner air cushion 2 are of a larger size than those of the outer air cushion 1. The inner air cushion 2 further has a hollow inlet 22 that is coaxial or almost coaxial with inlet 12 of the outer air cushion 1. The inlet 22 has a terminal end that does not protrude out of inlet 12 and an outer diameter that is smaller than the inner diameter of inlet 12.

Figure 16:
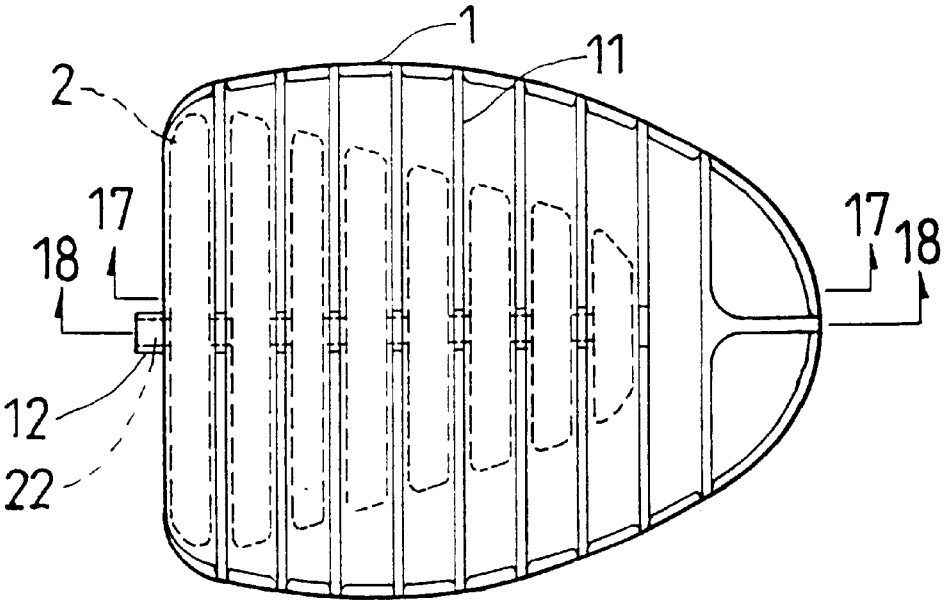
FIG. 16 is a top plan view of the second preferred embodiment of the inner and outer air cushions shown in FIGS. 10–15 assembled together.
Figure 17:
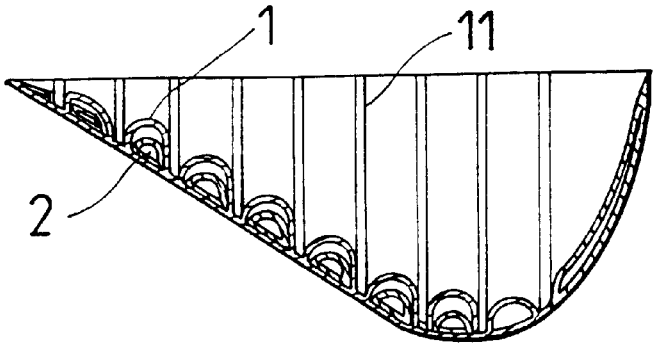
FIG. 17 is a cross-sectional view taken along the line 17—17 in FIG. 16.
Figure 18:
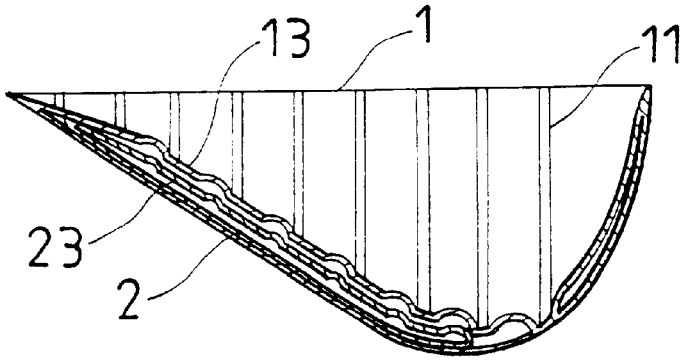
FIG. 18 is a cross-sectional view taken along the line 18—18 in FIG. 16.
Figure 19:
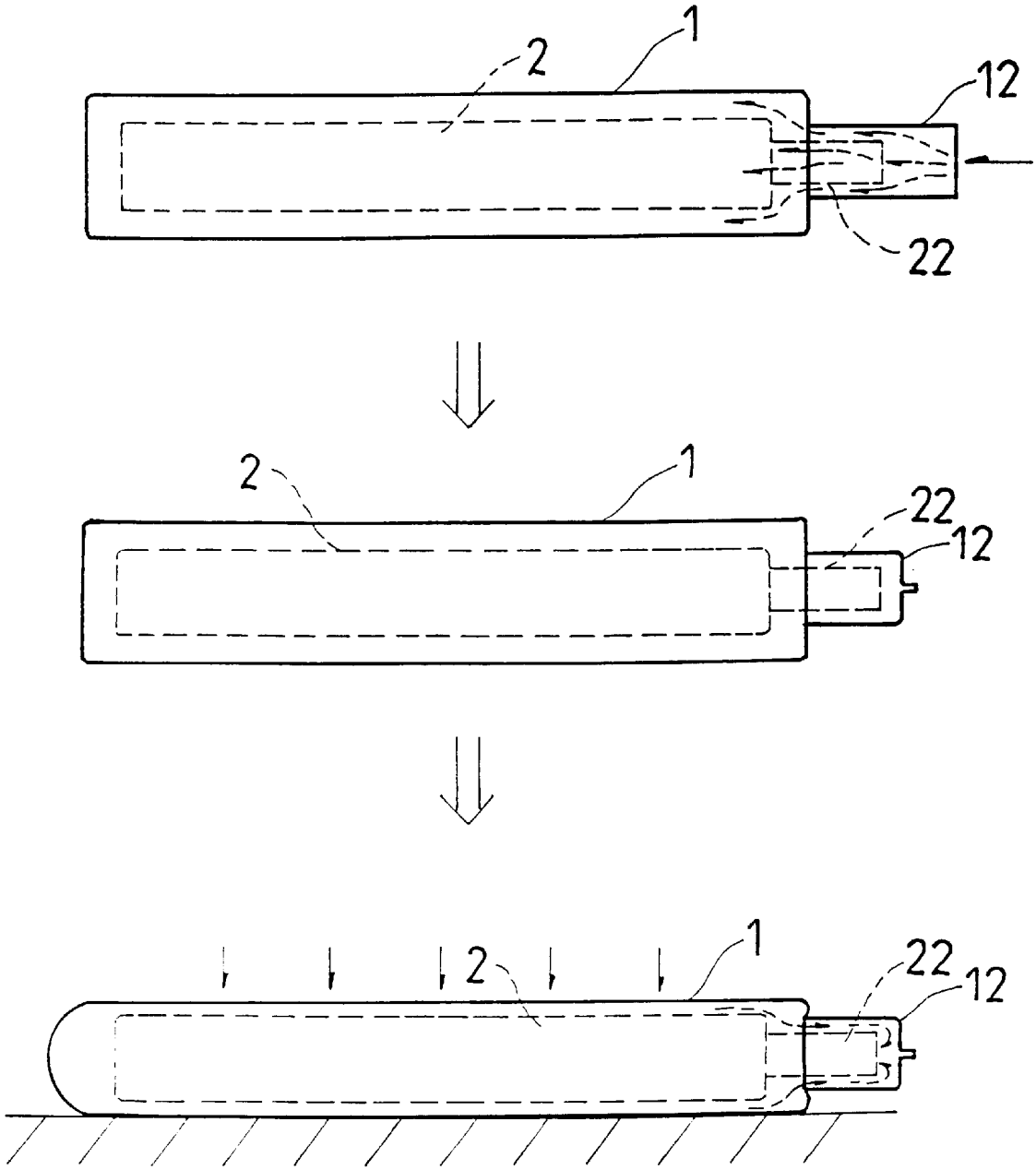
FIG. 19 is a side view of the buffer air cushion in the present invention, showing the manner of inflating same.
Figure 20:
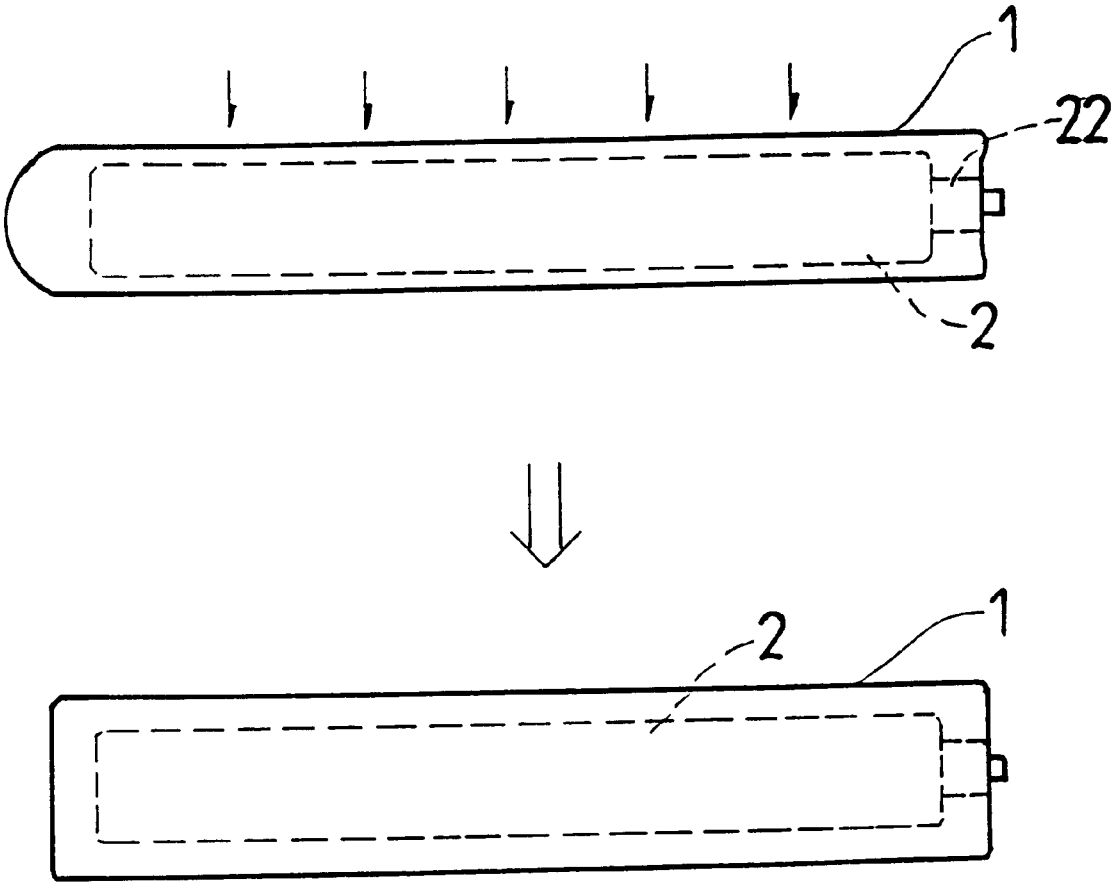
FIG. 20 is a side view of the buffer air cushion completely assembled and inflated according to the invention.

As seen from FIGS. 10–15, the outer air cushion 1 may have grooves 11 provided only in one surface, and connecting passageways 13 may be provided between two recessed grooves 11 to permit hollow chambers 15 separated by the grooves 11 to communicate with each other. As to the inner air cushion 2, connecting passageways 23 between two recessed grooves 11 may also be provided to correspond to the passageway 13 of the outer air cushion 1. Further, the passageways 13 have a larger inner diameter than the outer diameter of the passageways 23 of the inner air cushion 2. Besides, the inner and the outer air cushions 2, 1 may have a two-dimensional flat surface or a three-dimensional structure, with the hollow inner area being smaller than the outer surface area, thus forming a curved or cup-shaped configuration, as seen in FIGS. 13–18.

The inner and outer cushions of this invention are preferably made from a high density low-percolation polymeric material, such as polyimide, polyethylene, polypropylene, a copolymer formed from acetic acid and ethylene, polyester, polyamide, polyurethane, chlorinated polyethylene, butyl rubber, and the like. The material should also preferably be capable of being sealed or secured together by known heat sealing methods. Materials that are capable of being mechanically or compression sealed or secured together by known methods, or capable of being sealed or secured together by an electrical or electronic apparatus, such as radio frequency and the like, may also be used in the practice of the invention.

In manufacturing the invention, the outer air cushion 1 has one side fully open which is later sealed up after the inner air cushion 2 is inserted and disposed in the outer air cushion 1, and the recessed holes 10 or grooves 11, the inlets 12 and 22 and the connecting passageways 13 and 23 of both air cushions are respectively fitted with each other. Then the inner air cushion 2 is secured together with the outer air cushion 1 to form an integral buffer air cushion of the invention. In addition, the half-through recessed holes 10 or grooves 11 of the inner air cushion 2 may also be formed completely through and still be able to fit with the corresponding recessed holes 10 or grooves 11 of the outer air cushion 1 for assembling.

As to inflating the inner and the outer air cushions 2, 1, a preset pressure is first filled in both the air cushions, and then the inlet 12 is first sealed up. Next, the outer air cushion 1 is compressed to force its upper surface to contact the upper surface of the inner air cushion 2. Then the inlet 21 of the inner air cushion 2 is sealed up together with the inlet 12 of the outer air cushion 1. It is therefore apparent that inlet 12 undergoes a first sealing and a subsequent second sealing when inlet 21 is thereafter sealed. This double sealing procedure effectively joins inlets 12 and 21 into a single unit which maintains a pressure differential between the inner and outer air cushions 2,1. The sealing of inlets 12 and 21 may be accomplished as previously described with any known sealing method and apparatus through the application of heat, mechanical compression or electronically produced frequency.

When the outer air cushion 1 is not compressed, it maintains an original shape but, after compression, it has a lower pressure than its original inflation pressure since a part of its pressure is added to that of the inner air cushion 2, the latter then having the original pressure plus the additional pressure from the outer air cushion 1. For example, if the original pressure is 20 lbs. in both cushions 1 and 2, the inner air cushion 2 has a higher pressure then the outer air cushion 1 after the outer air cushion 1 is compressed and the passageway 22 is sealed. Then, the outer air cushion 1 may only have 10 lbs. of pressure and the inner air cushion 2 may have 30 lbs. of pressure. Since the inner air cushion 2 is surrounded by the outer air cushion 1, in effect, the practical pressure of the inner air cushion is only 20 lbs. i.e. 30 lbs.−10 lbs.=20 lbs. Consequently, the outer air cushion 1 is soft and comparatively elastic.

When the buffer air cushion receives a shock, the outer air cushion 1 first absorbs the shock with a buffer elasticity. When the upper surface of the outer air cushion 1 thereafter moves towards and touches the upper surface of the inner air cushion 2, the original preset pressure of 20 lbs. inflated therein produces its buffering effect. Therefore, the buffer air cushion according to the invention has a longer service life, a stronger structure, and a better buffering and shock-absorbing effect than conventional air cushions.

A gas filled in the inner and the outer air cushions 2,1 may be a low-percolating large particle gas, such as SF2, C2F6, etc.

While the preferred embodiments of the invention have been described above, it will be recognized and understood that various modifications may be made thereto and the appended claims are intended to cover all such modifications which may fall within the spirit and scope of the invention.

I claim:

1. A buffer air cushion assembly comprising:

a) a first cushion formed from two layers of material and including a plurality of separate first air chambers defined by a plurality of first recesses formed in at least one layer of material, a first hollow passageway providing fluid communication between the first air chambers for inflating same, and the first hollow passageway including a sealable first inlet for receiving an inflation fluid;

b) a second air cushion disposed within the first air cushion, the second air cushion including a plurality of separate second air chambers defined by a plurality of second recesses formed in the second air cushion, a second hollow passageway providing fluid communication between the second air chambers for inflating same, and the second hollow air passageway including a sealable second inlet for receiving an inflation fluid; and c) the first air chambers being in vertical overlapping alignment with the second air chambers whereby when the first and second air chambers are inflated, each corresponding aligned pair of first and second air chambers provide support for buffering and absorbing shock.

2. The air cushion assembly of claim 1 wherein the second hollow passageway is disposed within and is substantially coaxially aligned with the first hollow passageway.

3. The air cushion assembly of claim 1 wherein each recess is of a substantially round configuration.

4. The air cushion assembly of claim 1 wherein each recess is of a substantially straight groove configuration.

5. The air cushion assembly of claim 1 wherein the first air chambers are inflated to a first pressure level and the second air chambers are inflated to a second pressure level that is higher than the first pressure level.

6. The air cushion assembly of claim 1 wherein the assembly is of a curved configuration.

* * * * *